US005675863A

United States Patent [19]

Holden et al.

[11] Patent Number: 5,675,863

[45] Date of Patent: Oct. 14, 1997

[54] FULL COVERAGE SOOTBLOWER

[75] Inventors: W. Wayne Holden; Michael C. Holden, both of Houston, Tex.

[73] Assignee: Combustion Engineering, Inc., Windsor, Conn.

[21] Appl. No.: 520,369

[22] Filed: Aug. 28, 1995

[51] Int. Cl.[6] ..... F23J 3/02

[52] U.S. Cl. ..... 15/316.1; 15/318.1; 122/379

[58] Field of Search ..... 15/316.1, 317, 15/318, 318.1; 122/379, 390, 392

[56] References Cited

U.S. PATENT DOCUMENTS

| | | | |
|---|---|---|---|
| 2,442,045 | 5/1948 | Howse . | |
| 2,592,923 | 4/1952 | Lumb . | |
| 2,760,222 | 8/1956 | Andersson . | |
| 2,883,694 | 4/1959 | Hibner et al. | 15/317 |
| 3,604,050 | 9/1971 | Nelson et al. . | |
| 4,207,648 | 6/1980 | Sullivan et al. . | |
| 4,209,028 | 6/1980 | Shenker . | |
| 4,222,144 | 9/1980 | Horner et al. | 15/317 |
| 4,229,854 | 10/1980 | Johnston, Jr. . | |
| 4,351,082 | 9/1982 | Ackerman et al. | 15/316.1 |
| 4,360,945 | 11/1982 | Ackerman et al. . | |
| 4,445,465 | 5/1984 | Byrd et al. . | |
| 5,040,262 | 8/1991 | Albers et al. . | |
| 5,090,087 | 2/1992 | Hipple et al. . | |
| 5,097,564 | 3/1992 | Billings | 15/318 X |

*Primary Examiner*—Chris K. Moore
*Attorney, Agent, or Firm*—Browning Bushman

[57] ABSTRACT

The present invention is directed to a sootblower and particularly to a hub and drive assembly therefore capable of producing improved cleaning by directing the blowing medium over substantially all of the surface to be cleaned. A sootblower in accord with the present invention includes a hub and drive assembly for converting the alternating, clockwise and counter-clockwise rotary output of a reversible drive motor to uni-directional rotary movement of the sootblower lance. Further, the sootblower of the present invention provides an incremental degree of lost rotational movement each time the direction of longitudinal movement of the lance and nozzle assembly changes. Thus, the sootblower of the present invention moves the cleaning nozzles through different helical paths as the lance moves in the forward and reverse directions to provide a plurality of crossed helical paths as the drive assembly steps around the hub to produce substantially full coverage cleaning of the surfaces of adjacent heat exchanger tubes.

17 Claims, 7 Drawing Sheets

FULL COVERAGE SOOTBLOWER

BACKGROUND OF THE INVENTION

1. Field of the Invention

The present invention generally relates to sootblowers which are used to project a stream of a sootblowing medium against the heat transfer tubes in a combustion device. More specifically, the present invention is directed to a hub and drive assembly for converting the alternating, bi-directional rotary output of a reversible motor to uni-directional rotary movement of the lance and nozzle assembly of the sootblower.

2. Description of the Background

The combustion of fuel in large boilers, such as those found in electric and steam generating plants, and particularly in recovery boilers, such as those found in paper and pulp mills, results in the accumulation of large quantities of particulate matter on the interior surfaces of the boilers. Of greatest concern, is the accumulation of particulate matter, including soot and tars, on the surfaces of heat exchanger tubes in these boilers. Accumulation of particulates can quickly reduce the efficiency of such boilers by greatly reducing the amount of heat transferred from the combustion gases to the liquids to be heated or vaporized.

Operations burning coal produce large quantities of soot and/or slag. The lower the coal quality, the more soot and other particulates are produced and the quicker they build up and reduce the heat exchange efficiency. In order to maintain efficiency, regular cleaning must be conducted. Soot builds up extremely fast in the recovery boilers of pulp and paper mills where the combustion material is often bark and other waste wood products. Accordingly, a substantially continuous cleaning program is required to maintain efficient operations in the recovery boilers of pulp and paper mills.

Sootblowers were developed to provide this regular cleaning service. Typically, these sootblowers are permanently installed between adjacent rows of heat exchanger tubes to permit regular, if not substantially continuous, cleaning without requiring that the boiler be taken out of service. Accordingly, in large utility and paper mill operations, it is not uncommon to have fifty (50) or more sootblowers installed in conjunction with each boiler. These large banks of sootblowers provide substantially continuous cleaning through programmed cleaning cycles to remove accumulated soot and maintain the efficiency of the operating boiler. To maintain operating efficiency, each sootblower will be operated in a regular cycle, up to about once an hour, depending on the severity of soot build-up.

For more than thirty (30) years, the most widely used sootblower has been of a construction known as the long retracting type. Sootblowers of this type, with their long, retractable lance tubes have been installed in hundreds of utility and paper mill operations. These sootblowers generally comprise a long pipe or lance having a nozzle at one end for directing a blowing medium, generally steam or another vapor, onto the surfaces of the heat exchanger tubes. The lance is inserted through a hole in the wall of the furnace and should be of sufficient length to permit the nozzle to travel the entire length of the heat exchanger tubes within the furnace. The lance tube extends from a moveable carriage so that it may be reciprocated through the boiler.

While being advanced into and out of the boiler, the lance tube is generally rotated so that the cleaning nozzle near its end is caused to trace a helical path through the boiler. Exemplary of these sootblowers are those described and illustrated in U.S. Pat. Nos. 3,604,050; 4,229,854; 5,040,262; and 5,090,087, the disclosures of which are incorporated herein by reference. These patents all describe long, retractable lance tube sootblowers wherein the nozzle and blowing medium trace the same helical path during the forward and reverse traverses of the lance into and out of the furnace.

These conventional sootblowers all suffer from the same problem, i.e., because they all trace the same helical path into and out of the furnace, they fail to provide full coverage cleaning of the surrounding heat exchanger tubes. These conventional sootblowers all provide good cleaning action only along the single helical path traced by the nozzle during both entry and withdrawal from the boiler. Thus, soot, tar and other particulates can build up on heat exchanger surfaces not facing the single helical path traveled by the nozzle. This arrangement is doubly disadvantageous both because the resulting soot removal is irregular, being best only along the helical path, and because corrosion and mechanical stress will develop along that same helical path as a result of the high pressure blowing medium always striking the heat exchanger tubes at the same locations.

These disadvantages were recognized by Nils O. B. Andersson in U.S. Pat. No. 2,760,222, the disclosure of which is incorporated herein by reference. Andersson proposed an improved sootblower that would not suffer from these disadvantages. The sootblower disclosed by Andersson includes a lost motion device in the rotational drive transmission to cause the sootblower to be shifted longitudinally a short distance once during each operational cycle of the lance. That is, the rotational motion of the lance would be stopped for a short period at the beginning of its withdrawal from the furnace, resulting in the reverse helix being phase-shifted with respect to the forward helix. While this system does provide improved coverage and cleaning, it should be noted that, by merely shifting the phase of the helix, the nozzle will travel along a series of parallel, phase-shifted helices, continuing to leave poorly cleaned sections in the gaps therebetween.

The utility and paper industries have continued to seek improved sootblower technology. No known commercial devices or references have disclosed or suggested a practical sootblower capable of providing full coverage cleaning, wherein a series of phase-shifted, but otherwise mirror-image, helices are traced during the forward and reverse traversals of the boiler to provide a continuously changing cleaning path throughout a cleaning cycle. There has been a long felt but unfulfilled need in the industry for a sootblower with such capability. The present invention solves that need.

SUMMARY OF THE INVENTION

The present invention is directed to an improved sootblower adapted to deliver a high pressure stream of a blowing medium against the heat exchanger tubes in a furnace, e.g. a utility or recovery boiler. A sootblower in accord with the present invention includes a frame, a carriage mounted for longitudinal movement in the frame, a lance tube mounted for longitudinal and rotary movement in the frame, a valve for supplying a blowing medium to the lance tube, a nozzle on the lance tube for directing the blowing medium against the heat transmission tubes, a switching means for reversing the direction of the longitudinal movement of the carriage and lance tube, drive means for simultaneously imparting rotational and longitudinal movement to the lance tube and a coupling means within the drive means for maintaining rotational movement of the lance tube in the same direction irrespective of the direction of longitudinal movement of the carriage and lance tube and of the rotational movement of the drive means.

A sootblower in accord with the present invention will provide improved coverage and cleaning by causing the nozzle to move in different, preferably mirror image, helical paths during its forward and reverse traversals of the furnace. Because the lance on which the nozzle is disposed always moves in the same direction, the slope of the reverse helical path will be negative the slope of the forward helical path provided that the longitudinal and rotational speeds are maintained constant during the forward and reverse traversals. By providing a sootblower wherein the forward and reverse paths of the nozzle are different, significantly improved cleaning efficiency may be obtained.

In the preferred embodiment of the present invention, the coupling means further includes means for stopping the rotational movement of the lance tube for a predetermined time interval after each actuation of the switching means. This improvement results in a short period of lost motion at the beginning of both the forward and reverse movements of the lance tube, thus further varying the helical paths traced by the nozzle and further improving the cleaning coverage provided by the sootblower.

In the presently most referred embodiment, these improvements are achieved through a unique hub and drive assembly providing a novel means for converting the alternating, clockwise and counter-clockwise rotation of a reversible motor to the desired uni-directional rotation of the lance. In this preferred embodiment, the drive assembly comprises a bevel gear assembly having first and second rotary drive gears circumferentially disposed about the hub to which the lance is affixed. In this configuration, both rotary drive gears are simultaneously engaged with a pinion gear mounted on a shaft which transmits power from the reversible motor. However, only one of the rotary drive gears is engaged with the hub at any time to impart rotary movement to the hub in the desired single direction, while the other rotary drive gear freewheels about the hub in the opposite direction.

The rotary drive gears may be engaged with the hub through a ratchet and pawl assembly. In the most preferred embodiment, two sets of angled slots are milled circumferentially about the hub, one set for cooperation with each of the rotary drive gears. These slots provide a plurality, preferrably twelve to sixteen ratchets about the circumference of the hub. Carried on each rotary gear is at least one pawl, biased toward the hub for engagement with the ratchet teeth. In the presently most preferred embodiment, each gear carries a pair of diametrically disposed pawls to provide a balanced drive. Because the ratchet slots of each set are angled in the same direction, and because the rotary drive gears will rotate in opposite directions, one drive gear will engage and drive the hub while the other freewheels in the opposite direction. Reversing of the rotary direction of the pinion gear will alternate the engaged and freewheeling rotary drive gears so that the hub assembly will always be driven in the same direction.

In the most referred embodiment, the two sets of ratchet slots are not aligned, but are cut into the hub with a predetermined angular displacement relative to one another, preferrably half the angular distance between adjacent ratchet teeth. Accordingly, with each reversal in the rotational direction of the pinion gear, there will be a lost motion slippage as the drive gears reverse and the driving pawl slips before engaging the next offset ratchet tooth of the opposite drive. With twelve to sixteen ratchet slots associated with each drive gear, substantially full blowing coverage may be obtained as the hub assembly steps through the drive slots to move the nozzle through the resulting twenty-four to thirty-two differently located helices.

Thus, the long felt but unfulfilled need for a full coverage sootblower in the utility and recovery boiler industries has been met. These and other meritorious features and advantages of the present invention will be more fully appreciated from the following detailed description and claims.

BRIEF DESCRIPTION OF THE DRAWINGS

Other features and intended advantages of the present invention will be more readily apparent by the references to the following detailed description in connection with the accompanying drawings, wherein:

FIGS. 7A and 7B are cross-sectional illustrations through lines 7A—7A and 7B—7B, respectively, of FIG. 6A illustrating portions of the hub and drive assembly of a sootblower in accord with the present invention wherein FIG. 7A illustrates engagement of the ratchet and pawl drive as the drive gear is turned in the counter-clockwise direction and wherein FIG. 7B illustrates freewheeling of the ratchet and pawl assembly as the drive gear is rotated in the clockwise direction.

While the invention will be described in connection with the presently preferred embodiment, it will be understood that it is not intended to limit the invention to this embodiment. On the contrary, it is intended to cover all alternatives, modifications and equivalents as may be included in the spirit of the invention as defined in the appended claims.

DETAILED DESCRIPTION OF THE PREFERRED EMBODIMENT

The present invention provides an improved sootblower which is achieved in the preferred embodiment through use of a novel hub and drive assembly by which the alternating, clockwise and counter-clockwise rotary output of a reversible motor is converted to a uni-directional rotational movement of the lance and through which a lost motion adjustment is made with each change in lance direction.

Figure 1:
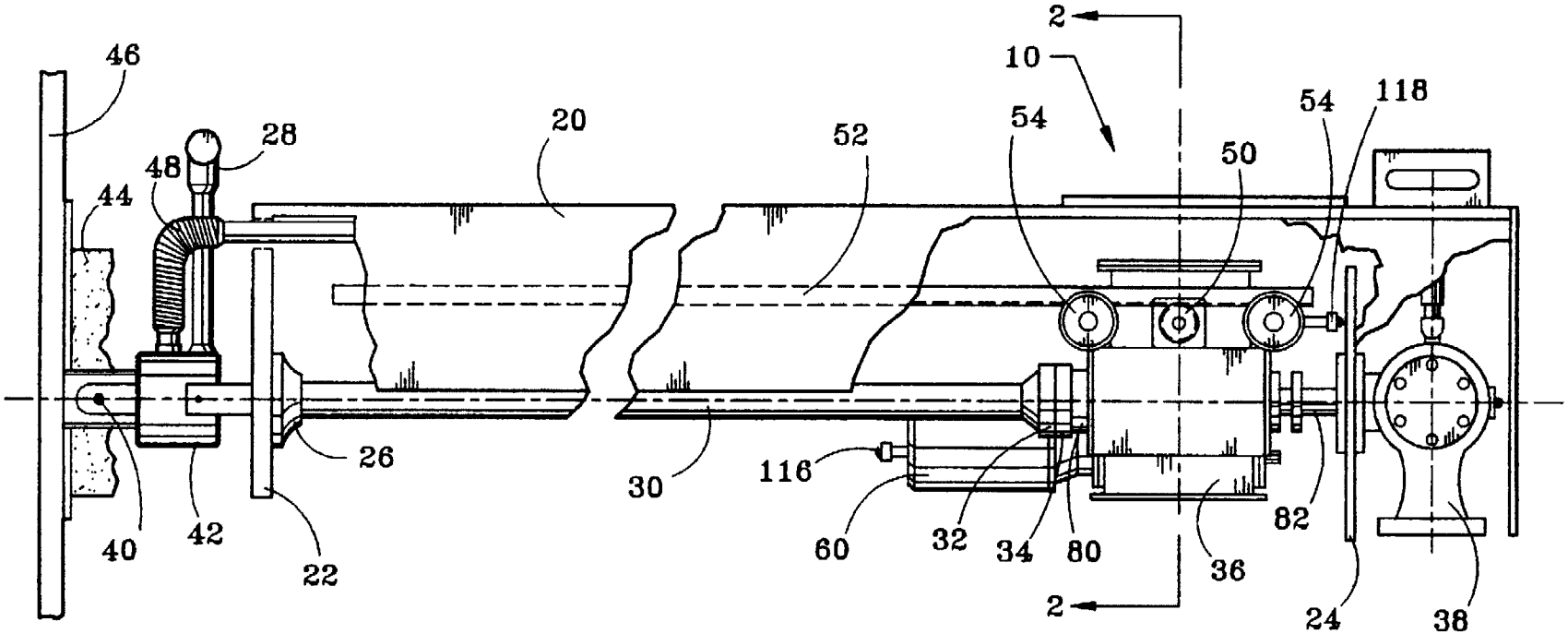
FIG. 1 is a side elevational view of a sootblower in accord with the present invention.

FIG. 1 illustrates a retracting lance sootblower 10 in accord with the present invention. The sootblower 10 of the present invention comprises a long, tubular lance 30 having one or more nozzles or apertures 40 at one end and terminating at the other end in a flange 32. The lance tube 30 may be of any desired length and is often as long as fifty to sixty feet for use in large, industrial utility boilers, or as long as twenty to thirty feet for use in recovery boilers. The lance tube 30 is permanently installed through the side of the boiler through a stuffing box 42 mounted in the side of the boiler wall 46 through insulation 44. The stuffing box 42 permits the lance tube 30 to be moved through the boiler while sealing thereabout to prevent escape of boiler gases. In fact, a positive pressure may be maintained at the stuffing box through air line 28. A separate steam line 48 may be provided, particularly with recovery boilers, to independently clean the outside diameter of the lance tube 30.

The lance tube 30 is connected through flange 34 of a hub 80 rotatably disposed within a traveling carriage 36. Connected through an appropriate feed tube 82 to the other side of hub 80 is connection valve 38 through which an appropriate blowing medium may be supplied. The preferred blowing medium is steam or another high pressure, high temperature vapor or gas. Traveling carriage 36 is suspended within shroud 20.

Figure 2:
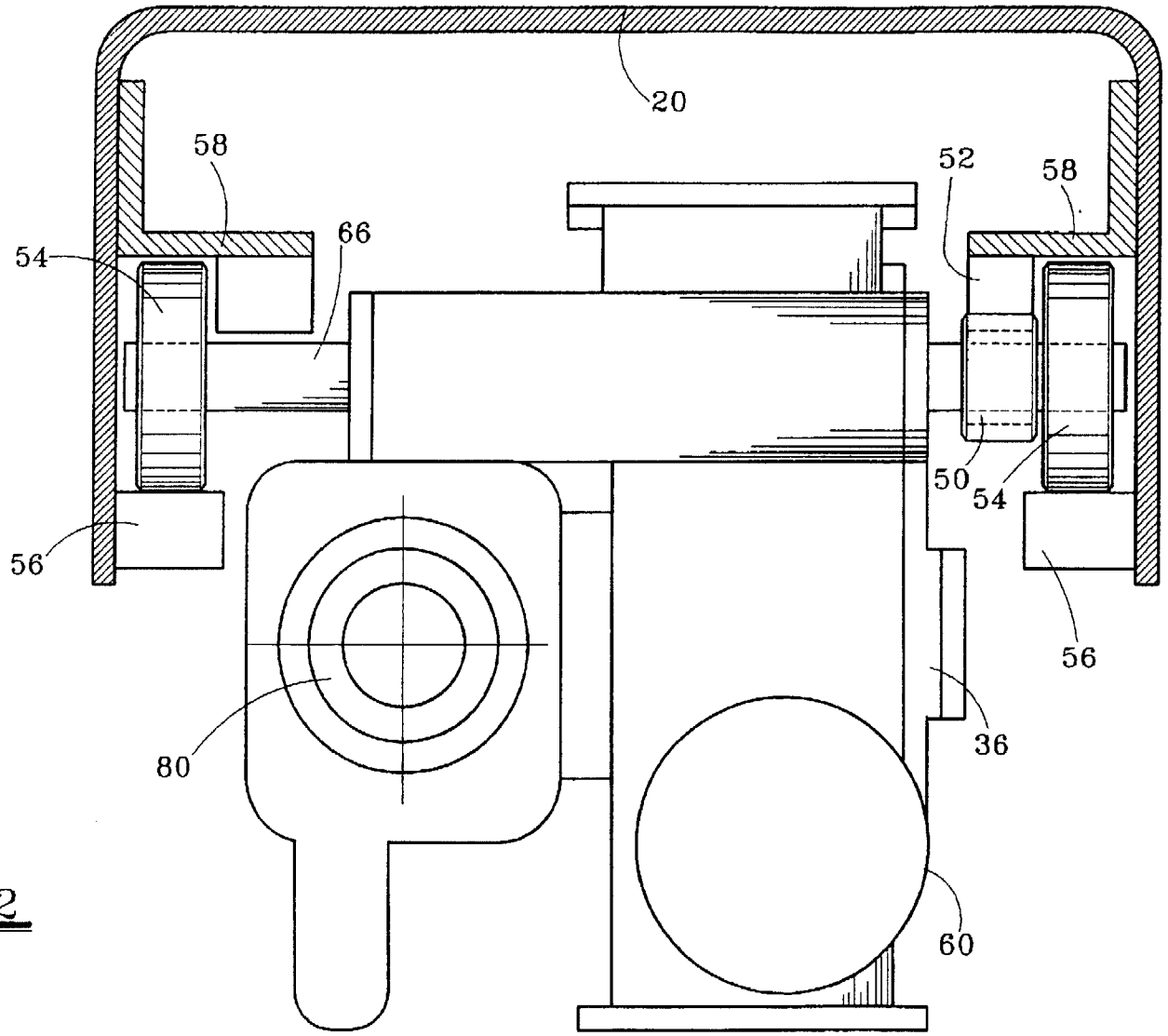
FIG. 2 is a partial cross-section and schematic representation throughout line 2—2 of FIG. 1 of a sootblower in accord with the present invention in order to illustrate more clearly the shroud and longitudinal rack and pinion drive.

The preferred means by which traveling carriage 38 is suspended and through which it is caused to move longitudinally within shroud 20 is more readily understood by reference to FIG. 2 in conjunction with FIG. 1. Shroud 20 typically comprises an inverted U-shaped steel frame. Fixed along each side of frame 20 is a lower track member 56 and an upper angled member 58. In the preferred embodiment illustrated in FIG. 2, carriage support rollers 54 are disposed at the ends of appropriate axles journaled through carriage 36. The support rollers 54 are sized to ride on lower track members 56 and to fit below upper track members 58. Mounted on the lower side of upper track member 58 on one or both sides of shroud 20 is a fixed gear track 52 for engagement by longitudinal drive gear 50 carried on axle 66.

Power to both move the carriage 36 and lance 30 longitudinally along track 52 and to rotate lance 30 is supplied by a single reversible electric motor 60. The direction of rotation of electric motor 60 is reversed each time carriage 36 reaches the limit of its travel within shroud 20. Reversal may be achieved by installing appropriate limit switches on the end walls 22 and 24 of shroud 20. Alternatively, and more conveniently, forward limit switch 116 and reverse limit switch 118 may be disposed at appropriate locations on carriage 36 for activation by contact with end walls 22 and 24, respectively, or with contact surfaces extending from the top or sides of shroud 20.

Figure 5:
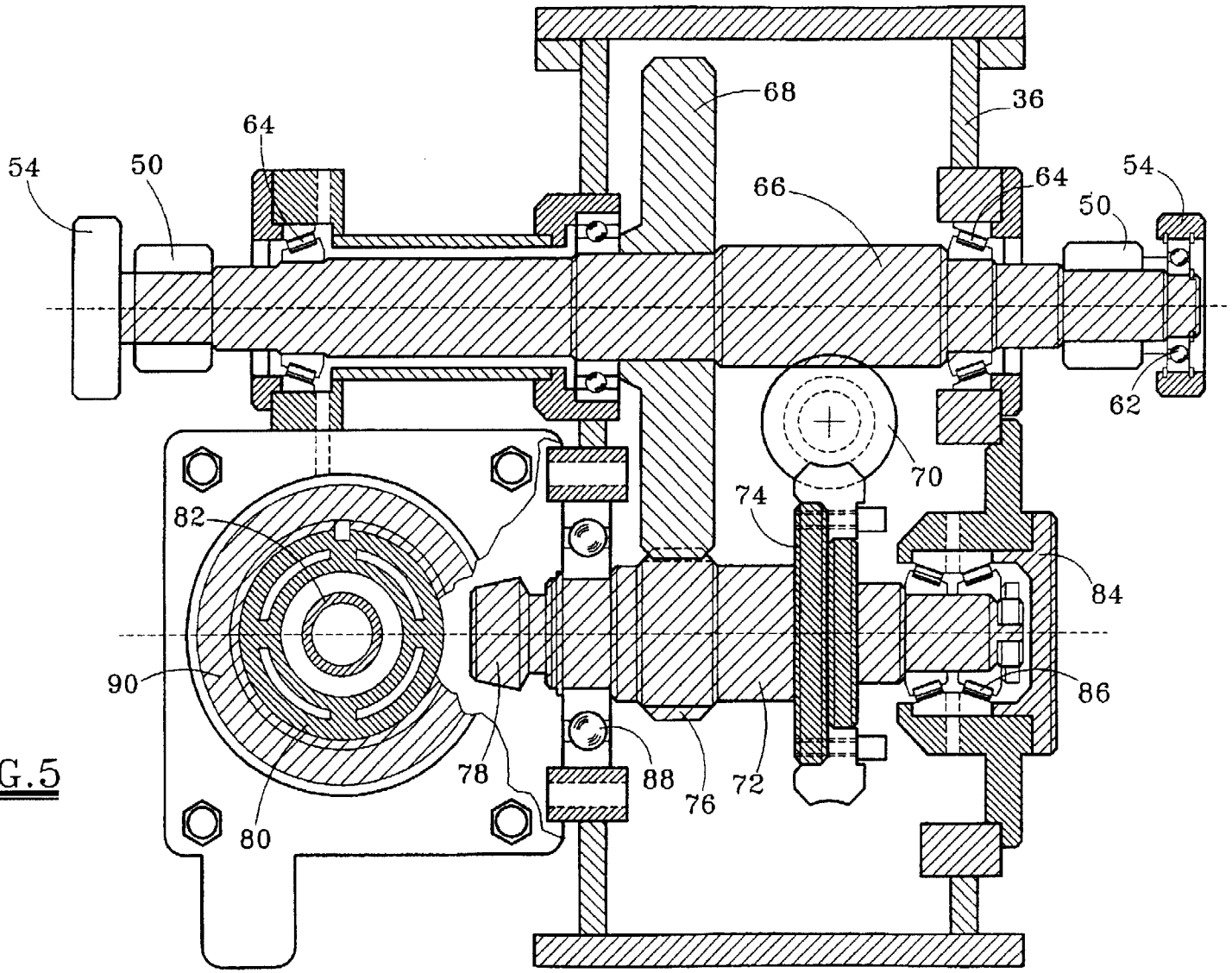
FIG. 5 is a cross-sectional illustration of a portion of the longitudinal and rotational drive assemblies of a sootblower in accord with the present invention.

The longitudinal and rotary drive assemblies of a sootblower in accord with the present invention are more clearly illustrated in FIG. 5. The rotary motion of drive motor 60 is transmitted by worm gear 70 to helical gear 74 disposed on drive shaft 72. One end of drive shaft 72 is journaled with roller bearings 86 into a hub 84 in the wall of housing 36.

The other end of drive shaft 72 is supported with ball bearings 88 in an opposite wall of housing 36 and terminates in beveled drive gear 78. Keyed to drive shaft 72 within housing 36 is pinion gear 76 for driving longitudinal drive gear 68 keyed to axle 66. Axle 66 is journaled with roller bearings 64 near both ends extending through the walls of housing 36. Keyed onto axle 66 for cooperation with gear track 52 is at least one drive gear 50. In order to provide balanced drive, it is preferred to use a pair of drive gears 50 cooperating with a pair of drive tracks 52. Supporting the weight of carriage 36 are a plurality of rollers 54.

Figure 6A:
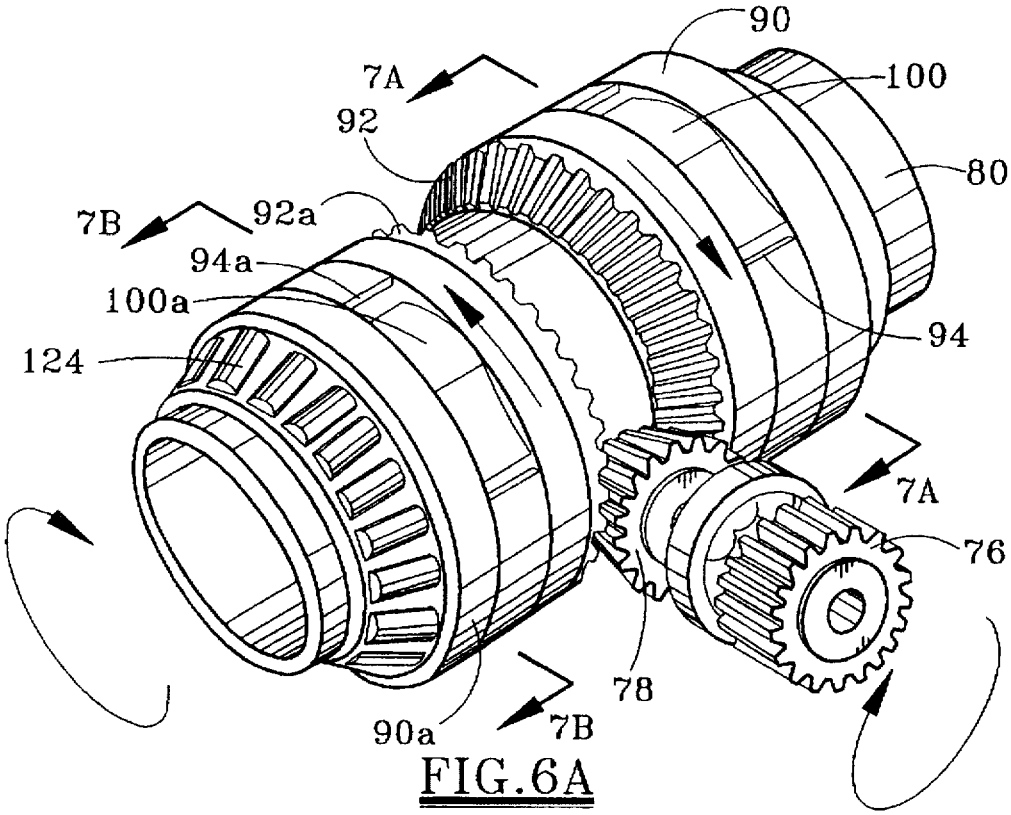
FIGS. 6A and 6B are perspective illustrations of the bevel gear drive assembly of a sootblower in accord with the present invention, and which illustrate the means by which rotation of the hub assembly is maintained in a single direction irrespective of the direction of rotation of the pinion gear and drive motor.
Figure 6B:
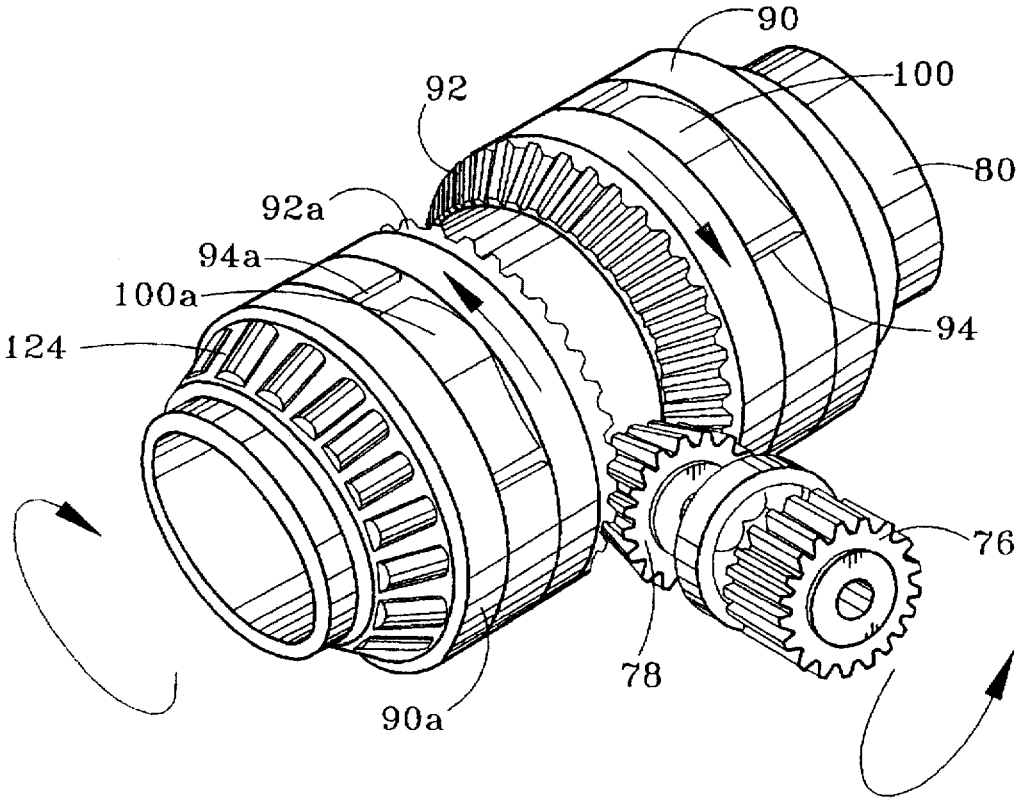

The operation of the drive assembly is more clearly understood with reference to FIGS. 6A and 6B. Beveled pinion gear 78 engages and rotates, in opposite directions, rotary drive assemblies 90 and **90*a* disposed about hub assembly 80. Neither rotary drive assembly 90 nor 90A is fixably engaged with hub 80. Only one of rotary drive assemblies 90 and 90A will be engaged with hub 80 at a time, the other freewheeling in the opposite direction (on a plurality of needle bearings 96 and 96*a* respectively). In FIG. 6A, rotary drive assembly 90 is engaged to drive hub 80 in the illustrated clockwise direction. The second rotary drive assembly 90*a*, turning counter-clockwise is disengaged and freewheeling about rotating hub 80. In FIG. 6B, with the direction of rotation of beveled pinion gear 78 being reversed, assembly 90*a* is engaged and driving hub 80, again in the clockwise direction, while assembly 90 freewheels in the counter-clockwise direction about hub 80. Appropriate arrows indicate the direction of rotation of pinion gear 78 and of drive assemblies 90 and 90*a*** in FIGS. 6A and 6B.

The driving force of beveled pinion gear 78 is transmitted to rotary drive assembly 90 or **90*a* through beveled gear teeth 92 or 92*a*, respectively. Disposed within slots 94, 94*a* respectively, in drive assemblies 90, 90*a* are rockers or pawls 100, 100*a* through which the driving force is transmitted to hub assembly 80**.

Figure 7A:
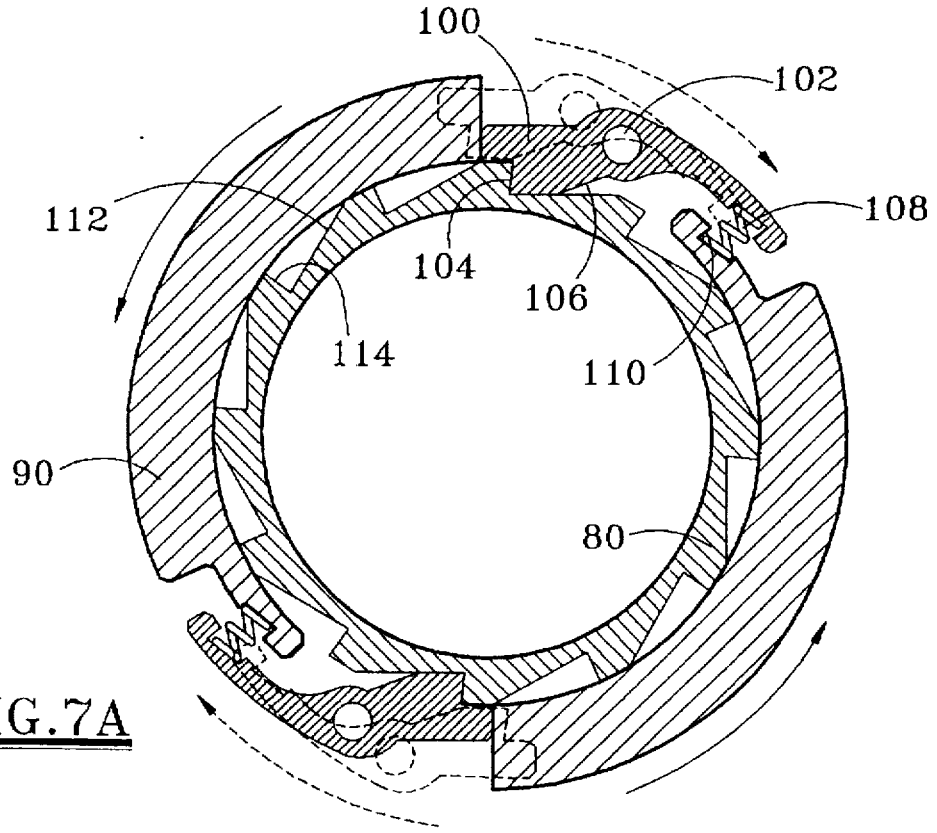
Figure 7B:
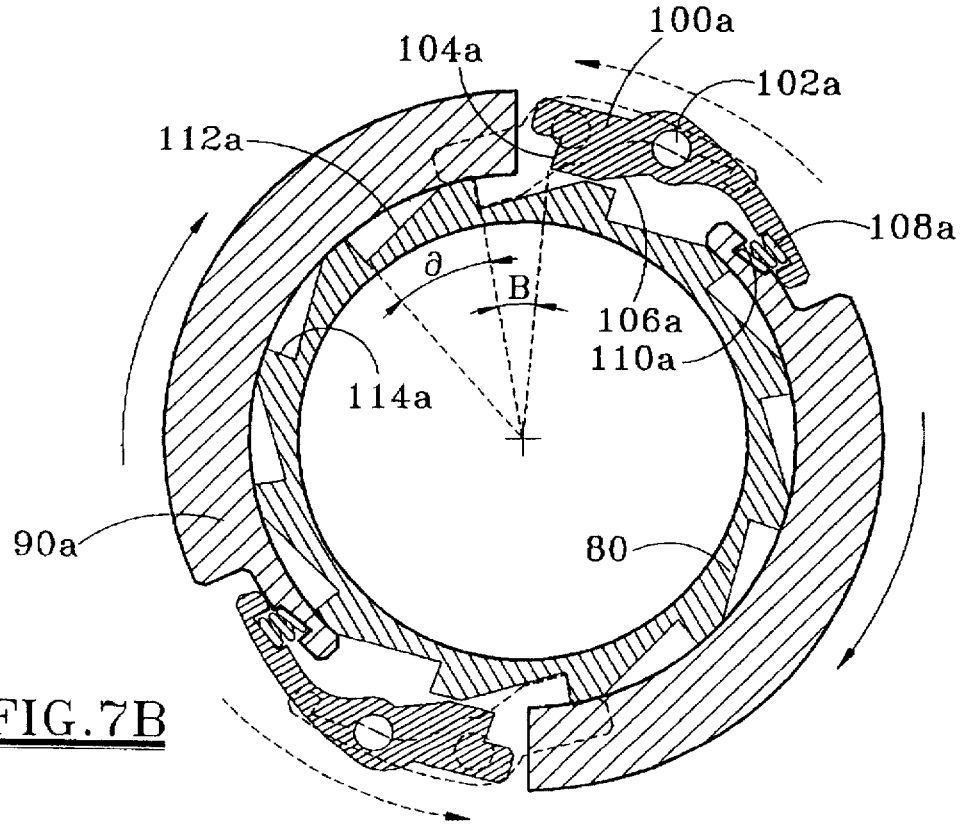

The drive mechanism may be more readily understood by reference to the cross-section of the ratchet and pawl coupling means illustrated in FIGS. 7A and 7B. In the presently most preferred embodiment illustrated, a plurality of angled slots 112, **112*a* have been cut about the periphery of hub 80 in the vicinity of both rotational drive gears 90, 90*a*. Angled slots 112, 112*a* terminate at one end in a substantially radial face 114, 114*a* providing a conventional ratchet tooth surface for cooperation with rocker or pawl 100, 100*a* rotatably journaled on pin 102, 102*a* axially passing through slot 94, 94*a* of drive assembly 90, 90*a*. Pawl or rocker 100, 100*a* includes a leading face 104, 104*a* for engagement with ratchet tooth 114, 114*a* and includes an angled trailing edge 106, 106*a* to minimize resistance while freewheeling in the opposite direction. Pawl or rocker 100, 100*a* is biased toward hub 80 by spring 108, 108*a*, disposed in detent 110, 110*a* in drive assembly 90, 90*a*. FIG. 7A illustrates the position of a rocker or pawl 100 engaged with and driving hub assembly 80. While hub assembly 80 is being rotated by drive assembly 90, drive assembly 90*a* will be rotating in the opposite direction, thus freewheeling about hub assembly 80** as illustrated in FIG. 7B or as ghosted in FIG. 7A.

In the presently most preferred embodiment, the positions of ratchet teeth **114*a* which cooperate with drive assembly 90*a* are angularly offset about the axis of hub 80 with respect to the positions of rachet teeth 114 which cooperate with drive assembly 90. The preferred angular offset is illustrated in FIGS. 7A and 7B where the angle of offset ($\beta$) is approximately one-half the angle ($\alpha$) subtended by adjacent ratchet teeth. In the configuration illustrated in FIGS. 7A and 7B hub assembly 80 includes twelve ratchet teeth 114 in each drive assembly. These rachet teeth are disposed symmetrically about hub 80, each being thirty degrees from the next. Accordingly, the offset for teeth 114***a* will be fifteen degrees in this preferred embodiment. Thus, as the drive alternates back and forth between drive assembly 90 and 90*a*, there will be fifteen degrees of lost motion each time the engaged drive assembly is changed.

Figure 8:
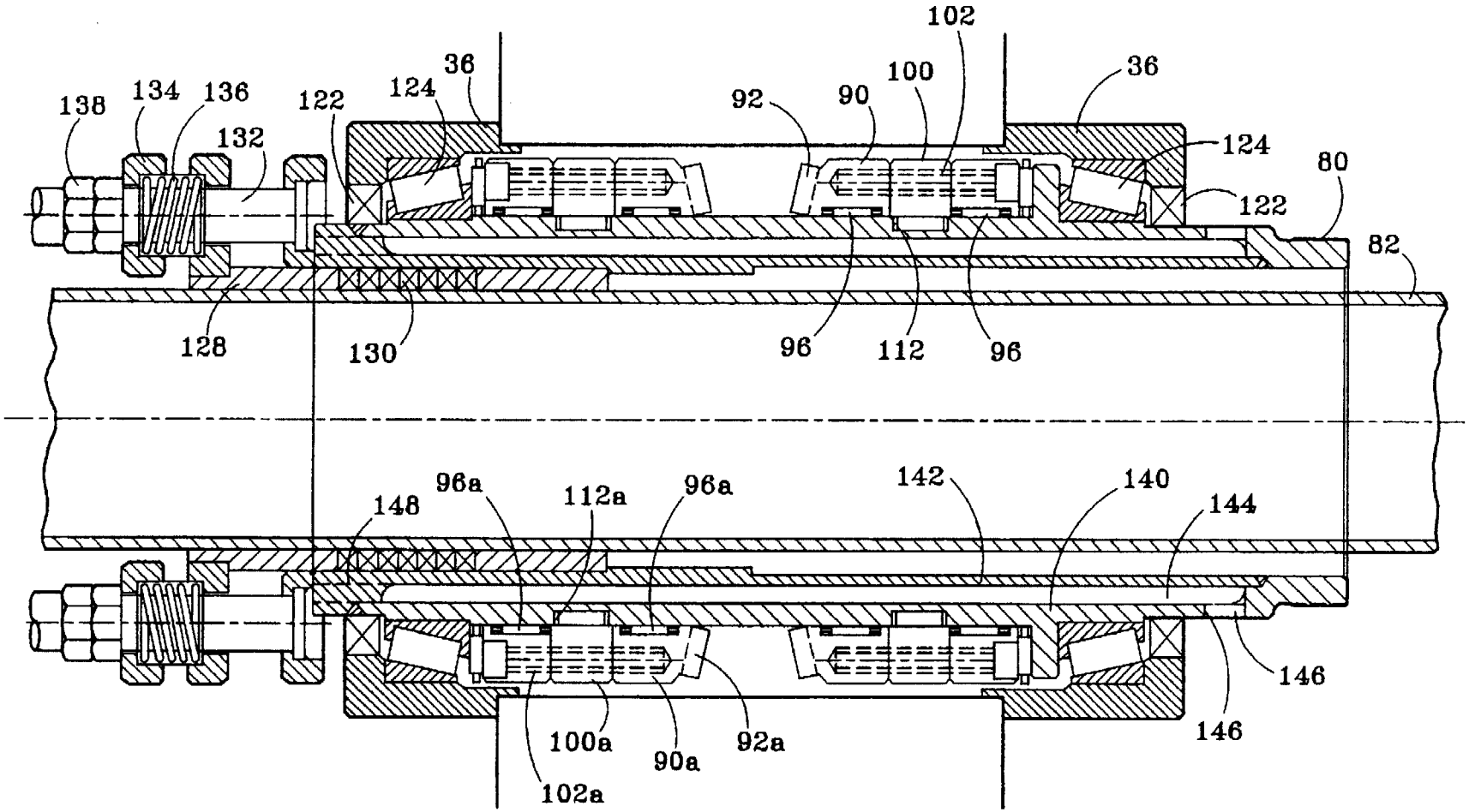
FIG. 8 is a cross-sectional illustration of a hub and drive assembly in accord with the present invention.

FIG. 8 illustrates in further detail the hub and drive assembly of the present invention. Passing through hub 80 is steam tube 82. Also illustrated are needle bearings 96, 96*a* upon which drive assemblies 90 and 90*a* revolve. In order to minimize expansion of hub assembly 80 as a result of steam passing therethrough and to prevent a catastrophic jamming or freezing of drive assemblies 90, 90*a* thereon, hub assembly 80 is preferrably constructed with a double wail configuration to provide natural air cooling. In this preferred embodiment, hub assembly 80 includes outer cylindrical wall 140 coaxially disposed about inner cylindrical wall 142 to produce an annular, cylindrical gap 144 therebetween. At one end of gap 144 a plurality of radial vent holes 146 are provided. At the other end of gap 144 a plurality of axial vent holes 148 are provided. Preferrably the total cross-sectional area of radial vent holes 146 is the same as that of axial vent holes 148. This configuration will permit air flow through gap 144 and efficiently dissipate heat which could build up and freeze drive assemblies 90, 90*a* to hub 80.

Hub assembly 80 is rotatably disposed within carriage 36 on a plurality of roller bearings 124 protected by seals 122. Seal 130 between hub 80 and steam line 82 prevents the blowing medium from escaping at the interface of these relatively rotating members. Seal 130 is engaged by sleeve 128 which is firmly held in place by nuts 138 on bolts 132 over springs 136 and flange 134.

Figure 3:
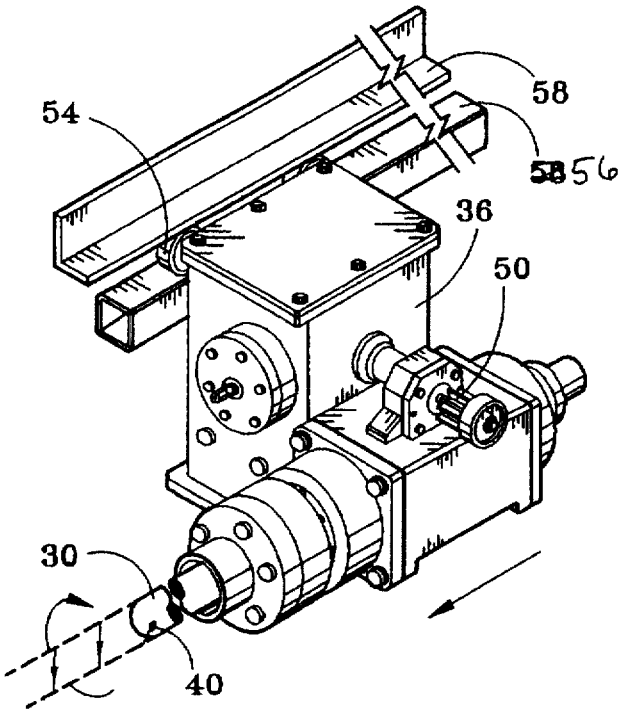
FIG. 3 is a perspective of the carriage and hub assembly of a sootblower, together with an illustration of a portion of the helix which will be traced by the nozzle during forward longitudinal movement of the carriage.
Figure 4A:
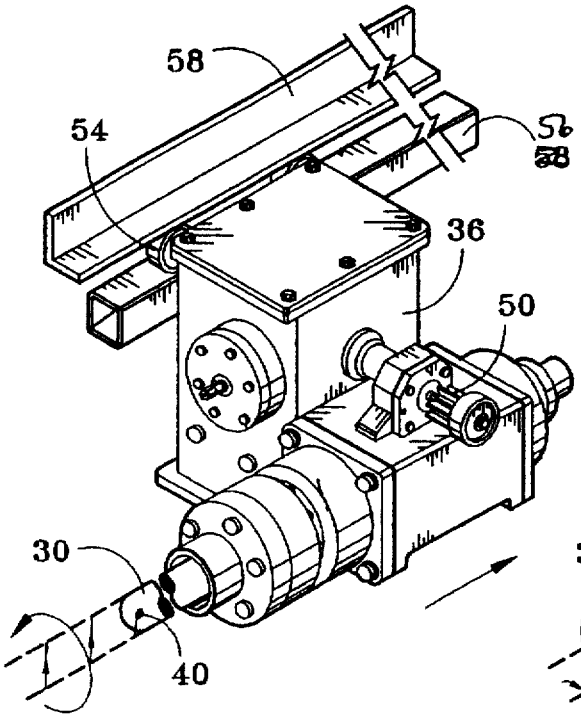
FIG.4A (PRIOR ART)
FIG. 4A is a perspective of the carriage and hub assembly of a sootblower, together with an illustration of a portion of the helix which will be traced by the nozzle during the reverse longitudinal movement of the carriage of a conventional sootblower wherein the rotational direction of the lance reverses simultaneously with the longitudinal direction of the carriage.

A sootblower employing the hub and drive assembly of the present invention provides improved cleaning by continuously altering the path traced by the blowing nozzle 40 through the furnace. In conventional retractable sootblowers, the nozzle 40 travels a helical path into the furnace, as partially illustrated in FIG. 3. In these conventional sootblowers, when the direction of longitudinal travel is reversed, the rotational direction of the lance 30 and thus of the nozzle 40 is also reversed. Thus, the same helical path is traveled in reverse as the nozzle 40 is withdrawn from the furnace. See the illustration in FIG. 4A.

Figure 4B:
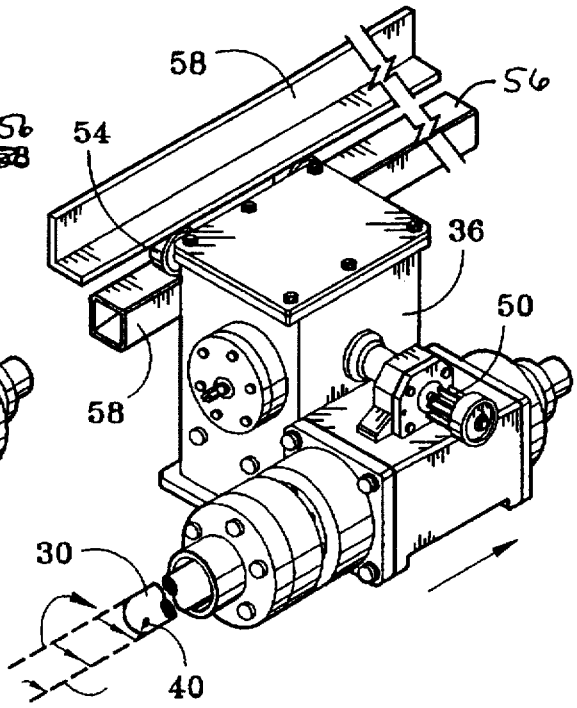
FIG. 4B is a perspective of the carriage and hub assembly of a sootblower in accord with the present invention, together with an illustration of a portion of the cross-helix which will be traced by the nozzle during the reverse longitudinal movement of the carriage wherein the rotational direction of the lance remains unchanged.

In the present invention, by maintaining the rotational direction of the lance 30 in the same direction, irrespective of the direction of travel of the carriage 36 and of rotation of the motor 60, the helical path traveled by the nozzle 40 as the carriage 36 reverses is different from that traveled in the forward direction. Where the speed of longitudinal and rotational movement is maintained constant, a cross-helix or mirror image helix is traced on the reverse travel. Compare the illustration in FIG. 4A with that in FIG. 4B. This helix may be described as having a slope which is negative with respect to that of the helix traced on the forward travel. For purposes of this application, slope may be defined as the ratio of axial movement to that of rotational or circumferential movement. It is easy to see that significantly improved cleaning will result from these different helical paths. Even better coverage is obtained as a result of phase shifting of the forward and reverse helices with each change in direction caused by the lost motion associated with the offset ratchet teeth 114, 114*a*. This additional movement is illustrated in FIG. 4B by the axial line illustrating longitudinal movement in the absence of rotational movement at the beginning of the reverse travel.

The foregoing description of the invention has been directed in primary part to a particular preferred embodiment in accordance with the requirements of the Patent Statues and for purposes of explanation and illustration. It will be apparent, however, to those skilled in the art that many modifications and changes in the specifically described system may be made without departing from the true scope and spirit of the invention. For example, in the preferred embodiment illustrated, the ratchet teeth 114, 114*a* were cut into the circumferential surface of hub assembly 80 for cooperation with rockers or pawls 100, 100*a* carded on the drive assemblies 90, 90*a*. While this configuration is preferred, it is believed that those skilled in the art could devise other suitable arrangements, e.g., the pawls 100, 100*a* could be placed on hub assembly 80 with the ratchet teeth 114, 114*a* disposed on the interior circumference of the drive assemblies 90, 90*a* to achieve the same objectives. Therefore, the invention is not restricted to the preferred embodiment described and illustrated but covers all modifications which may fall within the scope of the following claims.

What is claimed is:

1. A sootblower adapted to deliver a high pressure stream of cleaning fluid to steam generating tubes in a furnace, comprising:

an elongated shroud extending from a position adjacent the external wall of said furnace to a source of cleaning fluid;

a track within and extending substantially the length of said shroud;

a carriage supported from said track and reciprocable substantially the length of said shroud;

a sleeved hub rotatably mounted in said carriage;

a lance connected at a first end to said hub and extending into said furnace at a second end, said lance having at least one nozzle near its second end;

a feed tube connected at a first end to a source of cleaning fluid and extending through said hub and within said lance;

a seal between said lance and said feed tube to prevent the escape of cleaning fluid;

a rack mounted within and extending substantially the length of said shroud;

a pinion gear rotatably mounted on said carriage and engaged with said rack;

a switching means for reversing the direction of longitudinal movement of said carriage and lance tube actuatable by said carriage when in predetermined positions of its longitudinal movement, said positions defining the longitudinal displacement of said lance tube and said aperture within said furnace;

a reversible motor means connected by a linkage to said pinion gear to reciprocate said carriage along said shroud and said lance through said furnace;

drive transmission means connected to said reversible motor means for simultaneously imparting both rotational and longitudinal movement to said lance tube along at least a major part of said longitudinal displacement and causing said nozzle to move along a helical path within said furnace; and coupling means within said drive transmission means for maintaining rotational movement of said lance tube in the same direction irrespective of the direction of longitudinal movement of said carriage and lance tube or of the rotational direction of said reversible motor means.

2. The sootblower of claim 1 wherein the slope of the helical path traced by said nozzle during longitudinal movement of said lance in one direction is the negative of the slope of the helical path traced by said nozzle during longitudinal movement of said lance in the opposite direction.

3. The sootblower of claim 1 wherein said coupling means further comprises a means for stopping rotary movement of said hub and lance for a predetermined time interval with each change in direction of the longitudinal movement of said carriage and the rotary movement of said reversible motor.

4. The sootblower of claim 3 wherein said coupling means comprises:

a bevel gear assembly having first and second rotary drive gears circumferentially disposed about said hub, both rotary drive gears simultaneously engaged with a pinion gear mounted on a shaft for transmitting power from said reversible motor wherein only one of said first and second rotary drive gears is engaged with said hub at any time to impart rotary movement to said hub in said single direction, the other of said rotary drive gears freewheeling about said hub in the opposite direction.

5. The sootblower of claim 4 wherein said coupling means further comprises a set of first ratchet teeth peripherally disposed about said hub and cooperating with a first pawl on said first rotary drive gear and a set of second ratchet teeth peripherally disposed about said hub and cooperating with a second pawl on said second rotary drive gear.

6. The sootblower of claim 5 wherein there are the same number of ratchet teeth in each of said first and second sets of ratchet teeth.

7. The sootblower of claim 5 wherein no ratchet tooth in said first set is aligned parallel with any ratchet tooth in said second set, so that there is a period of lost rotary motion by said hub with each change in direction of the rotary movement of said reversible motor means.

8. The sootblower of claim 7 wherein the ratchet teeth in said first and second sets are rotated with respect to each other by half the distance between adjacent ratchet teeth.

9. The sootblower of claim 5 wherein said hub is a double walled hub comprising inner and outer cylindrical wall portions coaxially disposed to produce a cylindrical, annular gap therebetween, said gap in fluid communication with the exterior of said hub to provide air cooling through a plurality of vent holes at each end of said gap.

10. A sootblower adapted to deliver a high pressure stream of a fluid medium against heat transmission tubes in a furnace, comprising:

a frame;

a carriage mounted for longitudinal movement in said frame;

a lance tube mounted for longitudinal and rotary movement in said frame, said lance tube moving longitudinally in parallel with and simultaneously with said carriage;

a valve for supplying a blowing medium through said lance tube;

a nozzle on said lance tube comprising at least one aperture for emitting said blowing medium;

switching means for reversing the direction of longitudinal movement of said carriage and lance tube actuatable by said carriage when in predetermined positions of its longitudinal movement, said positions defining the longitudinal displacement of said lance tube and of said aperture within said furnace;

drive means for simultaneously imparting both rotational and longitudinal movement to said lance tube along at least a major part of said longitudinal displacement and causing said aperture to move along a helical path within said furnace, said drive means comprising a reversible motor and coupling means for maintaining rotational movement of said lance tube in the same direction irrespective of the direction of longitudinal movement of said carriage and lance tube wherein said coupling means comprises a generally cylindrical hub for mounting in said carriage, said hub having a first end configured to receive said lance tube and a second end configured for fluid communication with said valve; and a drive assembly for imparting rotary movement in a single direction to said hub and lance tube by converting rotary movement of said reversible motor in either direction to rotary movement in said single direction.

11. The sootblower of claim 10 wherein the slope of the helical path traced by said aperture during longitudinal movement of said lance in one direction is the negative of the slope of the helical path traced by said aperture during longitudinal movement of said lance in the opposite direction.

12. The sootblower of claim 10 whereto said coupling means further comprises means for stopping the rotational movement of said lance tube for a predetermined time interval after said switching means is actuated.

13. The sootblower of claim 10 wherein said drive assembly comprises:

a bevel gear assembly having first and second rotary drive gears circumferentially disposed about said hub, both rotary drive gears simultaneously engaged with a pinion gear mounted on a shaft for transmitting power from said reversible motor wherein only one of said first and second rotary drive gears is engaged with said hub at any time to impart rotary movement to said hub in said single direction, the other of said rotary drive gears freewheeling about said hub in the opposite direction.

14. The sootblower of claim 13 wherein said drive assembly comprises a plurality of first ratchet teeth surrounding said hub and cooperating with a first pawl on said first rotary drive gear and a plurality of second ratchet teeth surrounding said hub and cooperating with a second pawl on said second rotary drive gear.

15. The sootblower of claim 14 having an equal number of first and second ratchet teeth.

16. The sootblower of claim 14 wherein no first rachet tooth is aligned parallel with any second ratchet tooth, so that there is a period of lost rotary motion by said hub with each change in direction of the rotary movement of said reversible motor means.

17. The sootblower of claim 16 wherein said first and second ratchet teeth are rotated with respect to each other by half the distance between adjacent ratchet teeth.

* * * * *